US010391519B2

(12) United States Patent
Degott et al.

(10) Patent No.: US 10,391,519 B2
(45) Date of Patent: Aug. 27, 2019

(54) DEVICES FOR PRODUCING OPTICAL EFFECT LAYERS

(71) Applicant: SICPA HOLDING SA, Prilly (CH)

(72) Inventors: Pierre Degott, Crissier (CH); Mathieu Schmid, Lausanne (CH); Claude-Alain Despland, Prilly (CH); Evgeny Loginov, Renens (CH); Edgar Mueller, Lausanne (CH)

(73) Assignee: SICPA HOLDING SA, Prilly (CH)

( * ) Notice: Subject to any disclaimer, the term of this patent is extended or adjusted under 35 U.S.C. 154(b) by 255 days.

(21) Appl. No.: 15/101,717

(22) PCT Filed: Nov. 28, 2014

(86) PCT No.: PCT/EP2014/075943
§ 371 (c)(1),
(2) Date: Jun. 3, 2016

(87) PCT Pub. No.: WO2015/082344
PCT Pub. Date: Jun. 11, 2015

(65) Prior Publication Data

US 2016/0339474 A1 Nov. 24, 2016

(30) Foreign Application Priority Data

Dec. 4, 2013 (EP) ..... 13195717

(51) Int. Cl.
*B42D 25/40* (2014.01)
*B42D 25/485* (2014.01)
(Continued)

(52) U.S. Cl.
CPC ..... *B05D 3/207* (2013.01); *B05D 5/061* (2013.01); *B41M 3/14* (2013.01); *H01F 41/16* (2013.01);
(Continued)

(58) Field of Classification Search
CPC ... B05D 5/06; B05D 5/65; B05D 5/61; B05D 5/63; B05D 5/66; B05D 5/065;
(Continued)

(56) References Cited

U.S. PATENT DOCUMENTS 2,418,479 A * 4/1947 Pratt ..... B05D 3/207 106/198.1
2,570,856 A 10/1951 Pratt et al.
(Continued)

FOREIGN PATENT DOCUMENTS

CN 101152808 4/2008
CN 102171055 8/2011
(Continued)

OTHER PUBLICATIONS

J.H.E. Promislow et al. (Aggregation kinetics of paramagnetic colloidal particles, J. Chem. Phys., 1995, 102, p. 5492-5498.
(Continued)

*Primary Examiner* — Tabassom Tadayyon Eslami
(74) *Attorney, Agent, or Firm* — Muncy, Geissler, Olds & Lowe, P.C.

(57) ABSTRACT

The present invention relates to the field of the protection of value documents and value commercial goods. In particular, the invention relates to methods of making an optical effect layer (OEL) associated with a substrate, the method comprising i) providing a substrate associated with a coating composition comprising magnetic or magnetizable pigment particles; ii) providing a permanent magnet assembly producing a first magnetic field; iii) providing an electromagnet assembly including a winding assembly and drive producing an oscillating or rotating second magnetic field that interacts with the first magnetic field to spin the permanent magnet assembly to rotate the first magnetic field; and iv) applying the first magnetic field while the first magnetic field rotates
(Continued)

by spinning of the permanent magnet assembly to aggregately orient the magnetic or magnetizable pigment particles to create the optical effect layer. The invention also relates to apparatuses for creating an OEL.

8 Claims, 7 Drawing Sheets

(51) Int. Cl.
*B05D 3/00* (2006.01)
*B05D 5/06* (2006.01)
*H01F 41/16* (2006.01)
*B41M 3/14* (2006.01)

(52) U.S. Cl.
CPC ..... *B42D 2033/16* (2013.01); *B42D 2033/20* (2013.01)

(58) Field of Classification Search
CPC ..... B05D 5/061; B05D 5/063; B05D 5/066; B05D 5/067; B05D 5/068; B05D 3/207; B41M 1/22; B41M 1/14; B41M 1/26; B41M 1/36; B41M 3/14; H01F 7/06; B42D 25/29; B42D 25/00; B42D 25/20; B42D 25/40; B42D 25/48; B42D 25/485
USPC ..... 427/547, 598; 246/547; 430/39, 270.1; 101/491
See application file for complete search history.

(56) References Cited

U.S. PATENT DOCUMENTS

| | | | | |
|---|---|---|---|---|
| 3,676,273 | A | 7/1972 | Graves | |
| 3,791,864 | A | 2/1974 | Steingroever | |
| 5,364,689 | A | 11/1994 | Kashiwagi et al. | |
| 5,630,877 | A | 5/1997 | Kashiwagi et al. | |
| 6,126,790 | A * | 10/2000 | Moslehi | C23C 14/22 118/723 FE |
| 2007/0172261 | A1 * | 7/2007 | Raksha | B05D 3/207 399/266 |
| 2009/0004406 | A9 | 1/2009 | Argoitia | |
| 2012/0236088 | A1 | 9/2012 | Iftime et al. | |

FOREIGN PATENT DOCUMENTS

| | | | |
|---|---|---|---|
| EP | 0556449 | A1 | 8/1993 |
| EP | 0406667 | B1 | 1/1995 |
| EP | 0710508 | A1 | 5/1996 |
| EP | 0556449 | B1 | 3/1997 |
| EP | 1810756 | A2 | 7/2007 |
| EP | 2114678 | B1 | 7/2011 |
| EP | 2433798 | A1 | 3/2012 |
| WO | WO2002090002 | A2 | 11/2002 |
| WO | WO2004007095 | A2 | 1/2004 |
| WO | WO2004007096 | A2 | 1/2004 |
| WO | WO2005002866 | A1 | 1/2005 |
| WO | WO2006114289 | A1 | 11/2006 |
| WO | WO2008046702 | A1 | 4/2008 |
| WO | 2010037638 | | 4/2010 |
| WO | WO2012038531 | A1 | 3/2012 |

OTHER PUBLICATIONS

E. Climent et al. (Dynamics of self-assembled chaining in magnetorheological fluids, Langmuir, 2004, 20, p. 507-513.

* cited by examiner

DEVICES FOR PRODUCING OPTICAL EFFECT LAYERS

CROSS-REFERENCE TO RELATED APPLICATIONS

The present application is a U.S. National Stage of International Patent Application No. PCT/EP2014/075943 filed Nov. 28, 2014, and claims priority of European Patent Application No. 131 57 717.7 filed Dec. 4, 2013. Moreover, the disclosure of International Patent Application No. PCT/EP2014/075943 is expressly incorporated by reference herein in its entirety.

FIELD OF THE INVENTION

The present invention relates to the field of the protection of value documents and value commercial goods against counterfeit and illegal reproduction. In particular, the present invention relates to devices for use with printing or coating equipments, for orienting magnetic or magnetizable pigment particles in an unhardened coating composition on a substrate, and to processes for producing optical effect layers (OEL).

BACKGROUND OF THE INVENTION

It is known in the art to use inks, coating compositions, coatings, or layers, containing magnetic or magnetizable pigment particles, particularly also optically variable magnetic or magnetizable pigment particles, for the production of security elements, e.g. in the field of security documents. Coatings or layers comprising oriented magnetic or magnetizable pigment particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g. for security documents, can generally be classified into "covert" security features and "overt" security features. The protection provided by "covert" security features relies on the concept that such features require specialized equipment and knowledge for detection, whereas "overt" security features rely on the concept of being detectable with the unaided human senses, e.g. such features may be visible and/or detectable via the tactile senses while still being difficult to produce and/or to copy. However, the effectiveness of overt security features depends to a great extent on their recognition as a security feature, because users, and particularly those having no prior knowledge of the security features of a document or item secured therewith, will only then actually perform a security check based on said security feature if they have actual knowledge of its existence and nature.

Magnetic or magnetizable pigment particles in printing inks or coatings allow for the production of optical effect layers (OEL), comprising a magnetically induced image, design or pattern which is obtained through the application of a corresponding magnetic field, causing a local orientation of the magnetic or magnetizable pigment particles in the not yet hardened coating, followed by hardening the coating. The result is a permanently fixed magnetically induced image, design or pattern. Materials and technologies for the orientation of magnetic or magnetizable pigment particles in coating compositions by applying external magnetic fields have been disclosed in U.S. Pat. Nos. 3,676,273; 3,791,864; EP 406,667 B1; EP 556,449 B1; EP 710,508 A1; WO 2004/007095 A2; WO 2004/007096 A2; WO 20051002866 A1; as well as in WO 2008/046702 A1 and other documents; therein the applied external magnetic field remains essentially static with respect to the OEL during the orientation step, as can be produced with external permanent magnets or energized electromagnets. In such a way, magnetically induced images, designs and patterns which are highly resistant to counterfeit can be produced. The security element in question can only be produced by someone having access to both, the magnetic or magnetizable pigment particles or the corresponding ink, and the particular technology employed to print said ink and to orient said pigment in the printed ink.

The magnetic orientation patterns obtained or obtainable with static magnetic fields can be approximately predicted from the geometry of the magnet arrangement, through a simulation of the three-dimensional magnetic field line pattern.

By applying an external magnetic field, a magnetic pigment particle is oriented such that its magnetic axis is aligned with the direction of the external magnetic field line at the pigment particle's location. A magnetizable pigment particle without an intrinsic permanent magnetic field is oriented by the external magnetic field such that the direction of its longest dimension is aligned with a magnetic field line at the pigment particle's location. Once the magnetic or magnetizable pigment particles are aligned, the coating composition is hardened, and the aligned magnetic or magnetizable pigment particles are therewith fixed in their positions and orientations.

Highly useful, dynamic and aesthetically appealing security features based on magnetically induced images, designs or patterns providing the optical illusion of movement can be obtained by a dynamic interaction of magnetic or magnetizable pigment particles in an hardened coating composition with a time-varying external magnetic field. In this process the magnetic or magnetizable pigment particle dynamically interacts with its surrounding coating medium, adopting a position and an orientation of lowest hydrodynamic resistance. Detailed description of the involved mechanism was given by J. H. E. Promislow et al. (Aggregation kinetics of paramagnetic colloidal particles, *J. Chem. Phys.,* 1995, 102; p. 5492-5498) and by E. Climent et al. (Dynamics of self-assembled chaining in magnetorheological fluids, *Langmuir,* 2004, 20, p. 507-513).

In an attempt to produce coatings or layers comprising dynamically oriented magnetic or magnetizable pigment particles, methods for generating time-variable magnetic fields of sufficient intensity have been developed. Magnet assemblies and methods generating time-variable magnetic fields are described in EP 1 810 756 A2 and US 2007/0172261 A1 now U.S. Pat. No. 7,934,451. These means known in the art rely either on gears and shafts or on motors external to the spinning magnet to move or spin a permanent magnet within the body of a rotating cylinder of the printing or coating equipment.

CN 102529326 A discloses a magnetic orientation device comprising a drive device and a magnet, the drive device driving the magnet to rotate around a rotation shaft and the magnetic field produced by the rotating magnet being used for magnetically orienting magnetic or magnetizable pigment particles in magnetic ink printed on a substrate such as to form a magnetically oriented pattern with a three-dimensional appearance.

However, on certain printing machines, in particular sheet-fed and web-fed rotating printing machines, the mechanical constraints of the construction of the rotating cylinder of the printing or coating equipment do not allow the use of mechanical devices or electrical motors of the type known in the art. Therefore, the existing magnetic orienting devices and the technologies of the prior art do not provide for rotationally driving strong magnets within the constrained space available on the rotating cylinder of the printing or coating equipment, where only static magnets have been used hitherto.

Therefore, there remains a need for a modular, easily replaceable magnetic orienting device which fits into an existing rotating cylinder of the printing or coating equipment, and which is capable of generating a desired rotating magnetic field whilst being mechanically robust such as to withstand the acceleration forces on the printing machine.

SUMMARY OF THE INVENTION

Accordingly, embodiments of the present invention to overcome the deficiencies of the prior art as discussed above. In particular, embodiments are directed to a method of making an optical effect layer (OEL) associated with a substrate, said method comprising:

- providing a substrate associated with a coating composition comprising magnetic or magnetizable pigment particles;
- providing a permanent magnet assembly producing a first magnetic field;
- providing an electromagnet assembly including a winding assembly and drive producing an oscillating or rotating second magnetic field that interacts with the first magnetic field to spin the magnet assembly to rotate the first magnetic field; and
- applying the first magnetic field whilst the first magnetic field rotates by spinning of the permanent magnet assembly to aggregately orient the magnetic or magnetizable particles to create the optical effect layer.

The present invention also provides an apparatus for creating an optical effect layer (OEL) associated with a substrate, said apparatus comprising:

a substrate feeding mechanism, a spinneable permanent magnet assembly that produces a first magnetic field for orienting magnetic or magnetizable particles in a coating composition associated with the substrate, and an electromagnet assembly including a winding assembly and drive configured to produce an oscillating or rotating second magnetic field that interacts with the first magnetic field produced by the spinneable magnet assembly to spin the permanent magnet assembly, thereby rotating the first magnetic field to aggregately orient magnetic or magnetizable pigment particles comprised in a coating composition associated with the substrate to produce the optical effect layer.

The apparatus described herein comprises a first spinneable strong magnetic field generator for generating a first magnetic field strong enough to change the orientation of magnetic or magnetizable pigment particles in a wet and not yet hardened coating composition associated with the substrate upon exposure therewith and a second weak magnetic field generator for generating an oscillating or rotating second magnetic field weaker than the first field but sufficiently strong to interact with the first magnetic field thereby to cause the first strong magnetic field generator to spin thereby to rotate the first magnetic field to orient the magnetic or magnetizable pigment particles upon exposure of the substrate to the first magnetic field to produce a desired OEL. Preferably, the first strong magnetic field generator comprises a permanent magnet assembly and the second magnetic field generator comprises an electromagnet assembly. Preferably, the second magnetic field generated by the second magnetic field generator is too weak to alter the orientation of the magnetic or magnetizable pigment particles upon exposure of the magnetic or magnetizable pigment particles to the second magnetic field.

An advantage offered by the present invention is that the magnetic field required to orient the magnetic or magnetizable pigment particles is also used in interaction with the magnetic field of the electromagnet assembly to spin the permanent magnet assembly. This allows a compact and low power arrangement, e.g. as compared to a separate electric motor connected to the magnetic assembly by a transmission shaft. Whereas the present invention can produce the desired optical effect layer using only two magnetic fields, prior art arrangements require at least three or more magnetic fields, two associated with a motor and a third associated with the particle reorientation magnetic field to be set up to produce the desired effect. The need for a third or more magnetic fields is dispensed with.

Also described herein are uses of the apparatus described herein for making an optical effect layer on the substrate, said substrate being preferably a security document.

Also described herein are methods for protecting a security document, said method comprising i) applying the coating composition comprising magnetic or magnetizable pigment particles described herein on the substrate described herein, ii) exposing the coating composition to the magnetic field of the apparatus described herein so as to aggregately orient at least a part of the magnetic or magnetizable pigment particles, and iii) hardening the coating composition so as to fix the magnetic or magnetizable pigment particles in their adopted orientations.

BRIEF DESCRIPTION OF DRAWINGS

The magnetic direction is depicted as S→N in the figures.

FIGS. 8*a*-8*e* show three optical effect layers (OEL) obtained by applying a device described herein to an ink layer comprising magnetic or magnetizable particles, which is subsequently hardened.

DETAILED DESCRIPTION

Definitions

Figure 1A:
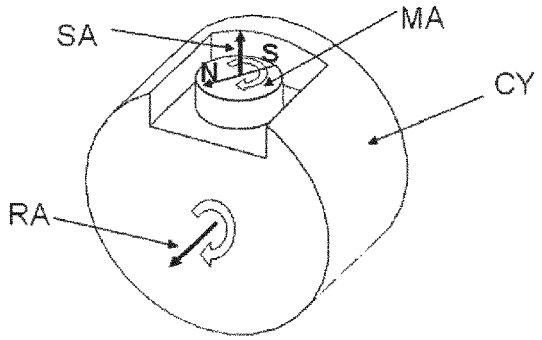
FIG. 1*a* schematically illustrates a rotating cylinder (CY) carrying a spinning permanent magnet assembly (MA) having its spinning axis (SA) perpendicular to the rotation axis (RA) of the rotating cylinder (CY) and perpendicular to the tangent of the rotating cylinder (CY) surface. The spinning axis (SA) extends orthogonally through the substrate carried on the cylinder (CY).

The following definitions clarify the meaning of the terms used in the description and in the claims.

As used herein, the indefinite article "a" indicates one as well as more than one and does not necessarily limit its referent noun to the singular.

As used herein, the term "about" means that the amount, value or limit in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value. However, a specific amount, value or limit supplemented with the term "about" is intended herein to disclose as well the very amount, value or limit as such, i.e. without the "about" supplement.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "comprising" as used herein is intended to be non-exclusive and open-ended. Thus, for instance a coating composition comprising a compound A may include other compounds besides A. However, the term "comprising" also covers, as a particular embodiment thereof, the more restrictive meanings of "consisting essentially of" and "consisting of", so that for instance "a coating composition comprising a compound A" may also (essentially) consist of the compound A.

As used herein, the term "wet coating" means an applied coating, which is not yet hardened, for example a coating in which the contained magnetic or magnetizable pigment particles are still able to change their positions and orientations under the influence of external forces acting upon them.

The term "coating composition" refers to any composition which is capable of forming a coating, such as an optical effect layer on a solid substrate and which can be applied e.g. by a printing method.

The term "optical effect layer (OEL)" as used herein denotes a layer that comprises oriented non-spherical magnetic or magnetizable pigment particles and a binder, wherein the orientation of the non-spherical magnetic or magnetizable pigment particles is fixed within the binder so as to form a magnetically induced image.

As used herein, the term "optical effect coated substrate (OEC)" is used to denote the product resulting from the provision of the OEL on a substrate. The OEC may consist of the substrate and the OEL, but may also comprise other materials and/or layers other than the OEL.

As used herein, the term "magnet assembly" (MA) is used to denote a device comprising at least one or more permanent magnets (M1, M2, M3, . . . Mn). The magnet assembly (MA) may comprise in addition one or more parts made of magnetizable material (Y1, Y2, Y3, . . . Yn) (also called pole pieces) and/or one or more parts of non-magnetic material.

The term "magnetic axis" or "South-North axis" denotes a theoretical line connecting the South and the North pole of a magnet and extending through them. These terms do not include any specific direction. Conversely, the term "South-North direction" and S→N on the figures denote the direction along the magnetic axis from the South pole to the North pole.

The term "spin", "spinneable", or "spinning" refers to the rotation of the permanent magnet assembly (MA) described herein, regardless of its rotation frequency.

The term "rotating cylinder" or "rotatable cylinder" refers to a rotating or rotatable cylinder being part of a printing or coating equipment, and bearing magnetic parts comprising one or more permanent magnet assemblies (MA) described herein, said rotating or rotatable cylinder being aimed at orienting magnetic or magnetizable particles of a wet and not yet hardened coating composition.

The term "substantially parallel" refers to deviating not more than 20° from parallel alignment and the term "substantially perpendicular" refers to deviating not more than 20° from perpendicular alignment.

The term "security element" or "security feature" is used to denote an image or graphic element that can be used for authentication purposes. The security element or security feature can be overt and/or covert.

DETAILED DESCRIPTION OF THE INVENTION

The present invention concerns a particular apparatus for making OELs with the help of spinneable permanent magnet assemblies (MA). The apparatus described herein is suitable to be part of a printing or coating equipment. In particular the apparatus described herein may be comprised in a rotating cylinder of a printing or coating equipment used for orienting magnetic or magnetizable pigment particles in a coating composition applied to a substrate.

The apparatus described herein comprises a first spinneable strong magnetic field generator for generating a first magnetic field strong enough to change the orientation of magnetic or magnetizable pigment particles in a wet and not yet hardened coating composition associated with the substrate upon exposure therewith and a second weak magnetic field generator for generating an oscillating or rotating second magnetic field weaker than the first field but sufficiently strong to interact with the first magnetic field. Said second magnetic field causes the first strong magnetic field generator to spin, thus rotating the first magnetic field to orient the magnetic or magnetizable pigment particles upon exposure of the substrate to the first magnetic field to produce a desired OEL. Preferably, the first strong magnetic field generator comprises a permanent magnet assembly and the second magnetic field generator comprises an electromagnet assembly. Preferably, the second magnetic field generated by the second magnetic field generator is too weak to alter the orientation of the magnetic or magnetizable pigment particles upon exposure of the magnetic or magnetizable pigment particles to the second magnetic field. In an embodiment of the method and apparatus aspects, the magnetic field produced by the electromagnet assembly is at least 2, at least 5, at least 10 times weaker than the strength of the magnetic field produced by the permanent magnet assembly at their strongest points, respectively. This arrangement reduces any interference that the electromagnet assembly has on orienting the magnetic or magnetizable pigment particles and also reduces power requirements for the electromagnet assembly.

The apparatus described herein has a surface to be brought in contact with, or close to, a substrate surface carrying a wet and not yet hardened coating composition comprising magnetic or magnetizable pigment particles in a binder. In the apparatus, the substrate is fed by the feeding mechanism in order to expose the magnetic or magnetizable pigment particles dispersed in the wet and not yet hardened coating composition to the magnetic field produced by the permanent magnet assembly. The magnetic or magnetizable pigment particles are considered to be exposed to the magnetic field when they are in sufficiently close proximity to the magnetic field such that the local field strength of the magnetic field is sufficiently strong to give rise to reorientation of the magnetic or magnetizable pigment particles in an aggregate way to produce the desired OEL. In an embodiment, a distance between the permanent magnet assembly and the coating composition on the substrate comprising the magnetic or magnetizable pigment particle is between 0.5 mm and 5 mm. The permanent magnet assembly is spinned thereby to rotate the first magnetic field. The rotating first magnetic field acts on the magnetic or magnetizable pigment particles dispersed in a wet and not yet hardened coating composition to induce an aggregate orientation thereby to create the desired OEL. By rotating the magnetic field produced by the permanent magnet assembly over the course of the exposure of the magnetic or magnetizable pigment particles to the first magnetic field, rotationally symmetric optical effects can be produced and the portion of the substrate carrying the OEL can continue to be fed downstream of the magnetic assembly. For example, an optical effect layer can be produced having a rolling area of relative brightness as the substrate is tilted. Example effects are disclosed in co-pending European patent applications 13150694.1 and 13150693.3.

The apparatus described herein comprises at least one spinneable permanent magnet assembly (MA), the spinning axis of which can have an arbitrary orientation with respect to the substrate surface, said spinning axis, in particular, can be substantially perpendicular (FIG. 1*a*) or substantially parallel (FIGS. 1*b* and 1*c*) to said substrate surface. During operation, said permanent magnet assembly (MA) is spinning at a required frequency. The permanent magnet assembly comprised in the apparatus described herein preferably has a predominant magnetization axis perpendicular to its spinning axis. However, other embodiments are also possible. In an embodiment of the apparatus and method aspects, a central axis of spinning of the permanent magnet assembly passes orthogonally through a part of the substrate over the course of exposure. Alternatively or additionally, the permanent magnet assembly defines one or more magnetic axes that extend parallel to a surface of the part of the substrate being subjected to the first magnetic field. These arrangements have been found to provide optically interesting effect layers.

The apparatus described herein comprises an electromagnet assembly including a winding assembly and drive. Said winding assembly comprises one or more windings in particular one or more magnet-wire coils, producing an oscillating or rotating second magnetic field that interacts with the first magnetic field to spin the permanent magnet assembly to rotate the first magnetic field.

Figure 2A:
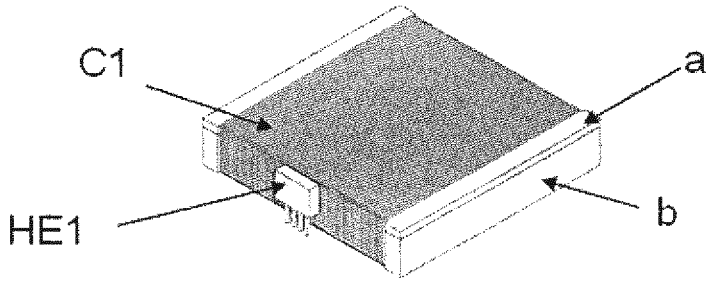
FIG. 2*a* schematically illustrates a device described herein comprising a housing (a and b), a magnet-wire coil (C1) and an optional Hall-effect element (HE1).
Figure 2B:
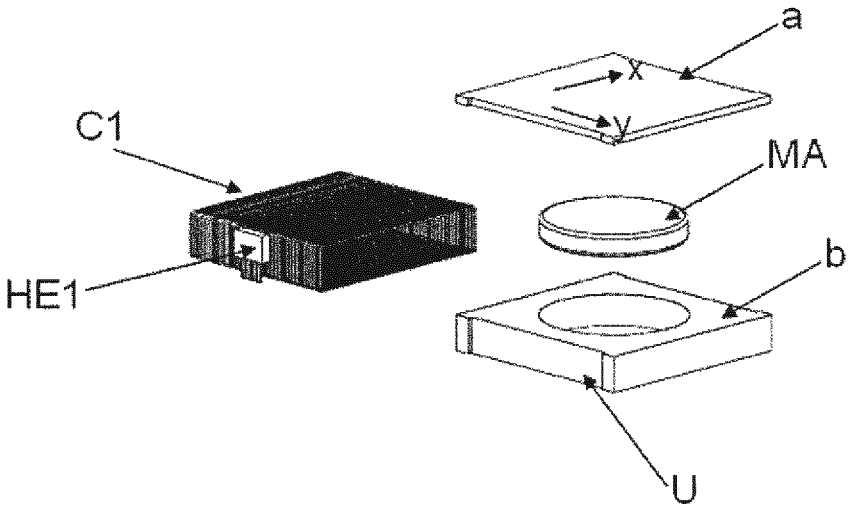
FIG. 2*b* is an explosion view of the device of FIG. 2*a* comprising a housing (a and b) with a notch (U), a permanent magnet assembly (MA), a magnet-wire coil (C1) and an optional Hall-effect element (HD).

As shown in FIGS. 2*a* and 2*b*, the apparatus described herein comprises a permanent magnet assembly (MA) as described herein, a housing made e.g. of pieces a and b, and one or more magnet-wire coils (Cn, n=1), which may be an air-wound magnet-wire coil. The permanent magnet assembly (MA) can be spun within an electromagnet assembly including a winding assembly comprising the one or more windings, in particular the one or more magnet-wire coils, by appropriately addressing said winding assembly with electric current.

The permanent magnet assembly (MA) of the device described herein simultaneously serves the functions of i) orienting magnetic or magnetizable pigment particles in a wet and not yet hardened coating composition and
ii) acting as the rotor of a motor assembly comprising the winding assembly, comprising the one or more windings in particular the one or more magnet-wire coils, and the permanent magnet assembly.

In this way it is possible to limit the driving mechanism to the strictly necessary parts and to reduce the size of the apparatus.

In an embodiment of the apparatus aspect, the permanent magnet assembly is configured as a rotor of a synchronous motor and the winding assembly and drive are configured as a stator of the synchronous motor such that the permanent magnet assembly spins synchronously with the oscillating or rotating second magnetic field. In an embodiment of the method aspect, the permanent magnet assembly spins synchronously with the oscillating or rotating second magnetic field. These embodiments provide for ease of control of the speed of spinning of the permanent magnet assembly.

The permanent magnet assembly is arranged with respect to the electromagnet assembly including a winding assembly so that when the portion of the substrate containing the magnetic or magnetizable pigment particles is brought into close proximity with the permanent magnet assembly, the first magnetic field reaches the substrate with sufficient strength to aggregately orient the magnetic or magnetizable pigment particles in a wet and not yet hardened coating composition as desired. Any housing or casing for the permanent magnet assembly, any interference from the oscillating or rotating second magnetic field of the electromagnet assembly and any intermediate materials between the permanent magnet assembly and the substrate are, therefore, preferably suitably selected to prevent hindrance of the penetration and desired form of the first magnetic field exposed to the magnetic or magnetizable pigment particles.

The permanent magnet assembly (MA) described herein comprises thus at least one or more permanent magnets (M1, M2, M3, . . . Mn). When the permanent magnet assembly (MA) comprises more than one permanent magnet, the South-North direction of each of the permanent magnets (M1, M2, M3, . . . Mn) may be arranged in any relative orientation to each other. When the permanent magnet assembly (MA) comprises more than one permanent magnet, the permanent magnets may be made of the same magnetic material or of different magnetic materials. Alternatively, the permanent magnet assembly (MA) may comprise one or more permanent magnets (M1, M2, M3, . . . Mn) together with one or more parts of magnetizable material (Y1, Y2, Y3, . . . Yn), and/or one or more parts of non-magnetic material.

The at least one or more permanent magnets (M1, M2, M3, . . . Mn) comprised in the permanent magnet assembly (MA) described herein are made of strong magnetic material. The at least one or more permanent magnets have a sufficiently strong magnetic field to orient the magnetic or magnetizable pigment particles and this strength of magnetic field is utilized in interaction with the oscillating or rotating second magnetic field of the electromagnet assembly including a winding assembly comprising one or more windings, in particular one or more magnet-wire coils, to spin the permanent magnet assembly. Suitable strong magnetic materials are materials having a maximum value of energy product $(BH)_{max}$ of at least 20 kJ/m$^3$, preferably at least 50 kJ/m$^3$, more preferably at least 100 kJ/m$^3$, even more preferably at least 200 kJ/m$^3$.

The at least one or more permanent magnets (M1, M2, M3, . . . , Mn) comprised in the permanent magnet assembly (MA) are preferably made of sintered or polymer bonded magnetic material selected from the group consisting of Alnicos such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite, ceramic 5 (SI-1-6), ceramic 7 (SI-1-2), ceramic 8 (SI-1-5); rare earth magnet materials selected from the group comprising $RECo_5$ (with RE=Sm or Pr), $RE_2TM_{17}$ (with RE=Sm, TM=Fe, Cu, Co, Zr, Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14.

According to one preferred embodiment, the permanent magnet assembly (MA) has an exterior neat magnetic dipole moment orthogonal to its spinning axis. This has the advantage that the permanent magnet assembly is drivable inside a single magnet-wire coil.

When the permanent magnet assembly (MA) comprises two or more permanent magnets (M1, M2, M3, . . . Mn), the two or more permanent magnets are preferably disposed in a mechanically symmetric arrangement with respect to the spinning axis such that the permanent magnet assembly (MA) is mechanically balanced when spinning. On the other hand, the two or more permanent magnets may be magnetically symmetric or magnetically non-symmetric with respect to the spinning axis (SA) of the permanent magnet assembly (MA).

According to another preferred embodiment, the permanent magnet assembly (MA) comprises a spinning permanent magnet (M1) and one or more secondary magnets (M2, M3, . . . Mn), one of said secondary magnets being an engraved magnetic plate such as those disclosed for example in WO 2005/002866 A1 and WO 2008/046702 A1, in the aim of locally modifying the magnetic field of the permanent magnet (M1). The engraving influences the first magnetic field to create the desired OEL, in an embodiment, the engraving represents at least part of the desired OEL and is reproduced in the magnetic or magnetizable pigment particles under the influence of the first magnetic field.

According to another preferred embodiment, the permanent magnet assembly (MA) may comprise, in addition to the permanent magnet (M1) and/or to the secondary magnets (M2, M3, . . . Mn), one or more parts made of magnetizable material (Y1, Y2, Y3, . . . Yn). The magnetizable parts are also called pole pieces, and serve to direct the magnetic field generated by the permanent magnets of the magnet assembly. The one or more pole pieces preferably comprise one or more materials having high magnetic permeability, preferably a permeability between about 2 and about 1,000,000 $NA^{-2}$ (Newton per square Ampere), more preferably between about 5 and about 50,000 $NA^{-2}$ and still more preferably between about 10 and about 10,000 $NA^{-2}$. The pole pieces serve to direct the magnetic field generated by the magnets. Preferably, the one or more pole pieces described herein comprise or consist of iron yokes (Y); but they can also be made from a plastic material in which magnetizable particles are dispersed. The one or more pole pieces may be made of the same material, or of different materials.

For orienting magnetic or magnetizable pigment particles in a coating composition the magnetic field of the permanent magnet assembly (MA) must be accessible at the exterior of the apparatus.

The permanent magnet assembly (MA) described herein may take the shape of a disc or of a regular polygon, said disc or polygon optionally comprising a circular or a polygonal hole. Optionally, the circular or polygonal hole may be filled with at least one material selected from the group consisting of non-magnetic materials, magnetizable materials and permanent magnetic materials. In a particular embodiment, the permanent magnet assembly (MA) has the shape of a circular ring.

Alternatively, the permanent magnet assembly (MA) may take the shape of an irregular polygon or of any irregular body. In such a case, the permanent magnet assembly may be comprised in a casing having the external shape of a disc or of a regular polygon as described above, in order to correctly balance the mechanical forces while spinning. The additional pieces needed to complete the casing are made of at least one material selected from the group consisting of non-magnetic materials, magnetizable materials and permanent magnetic materials.

In an embodiment of the method and apparatus aspects, the permanent magnet assembly is provided as a flat object. This feature allows for ease of integration into the apparatus, particularly into recesses located in the outer peripheral surface of the above described cylinder. In an embodiment, the permanent magnet assembly is arranged so that the spinning is about a central axis passing through opposed major surfaces of the flat object. In an embodiment, the permanent magnet assembly includes one or more circumferential edges extending between the opposed major surfaces to form bearing surfaces that bear against corresponding bearing surfaces of a housing during spinning of the permanent magnet assembly.

The permanent magnet assembly (MA) described herein is dipolar or multipolar. When the permanent magnet assembly is multipolar, it may be quadrupolar, hexapolar, octapolar, decapolar or dodecapolar. Preferably the permanent magnet assembly is dipolar or quadrupolar and even more preferably it is dipolar.

Similarly, the magnetic field of the stator, i.e. the assembly comprising a housing made of for example two pieces a and b, and the electromagnet assembly including a winding assembly comprising one or more windings, in particular the one or more magnet-wire coils ($C_n$, n=1), is preferably kept as weak as possible, in order to reduce to the minimum any perturbation of the magnetic orientation of the magnetic or magnetizable pigment particles induced by the permanent magnet assembly (MA). The sole function of the stator is to maintain the spinning movement of the permanent magnet assembly (MA) in rotation at the desired frequency against frictional forces.

The spinning frequency of the permanent magnet assembly is preferably chosen such that the permanent magnet assembly undergoes at least one complete revolution over the course of exposure of the magnetic or magnetizable pigment particles to the magnetic field. The permanent magnet assembly will spin at least once through a full revolution to ensure that a rotationally symmetric aggregate orientation of the magnetic or magnetizable pigment particles is produced by the resulting rotating of the first magnetic field to create the desired optical effect layer. When the permanent magnet assembly described herein is part of a rotating cylinder for orienting magnetic or magnetizable pigment particles of the printed coating composition, the required spinning frequency depends on the printing speed of the printing or coating equipment comprising said rotating cylinder, on the position of the hardening device and on the construction of the permanent magnet assembly (MA). In an embodiment, the winding assembly and drive are configured to produce the oscillating or rotating second magnetic field so that the permanent magnet assembly undergoes at least one complete revolution whilst the substrate is supported by the cylinder and held relatively stationary with respect thereto. The speed of rotation of the outer periphery of the rotating cylinder, and thus the speed of movement of substrate in the machine direction, and the speed of spinning of the permanent magnet assembly are set such that the permanent magnet assembly revolves at least once while the corresponding part of the substrate is on the rotating cylinder and hence exposed to the first magnetic field. The exposed portion of the substrate, and thus the magnetic or magnetizable pigment particles, remains stationary relative to the rotating cylinder during spinning of the first magnetic field to ensure the quality of the optical effect layer. In an embodiment of the method aspect, the permanent magnet assembly spins through at least one complete revolution during application of the rotating first magnetic field to the magnetic or magnetizable pigment particles as the permanent magnet assembly and the substrate move in the machine direction at the same speed.

For typical industrial printing speeds of at least 8000 sheets per hour, e.g. 8,000 to 10,000 sheets per hour, the required spinning frequency is preferably at least around 5 Hz, more preferably at least around 20 Hz, and even more preferably at least around 50 Hz.

After application of the coating composition, preferably by a printing process, said printing process being preferably selected from the group consisting of screen printing, rotogravure printing and flexography printing, the magnetic or magnetizable pigment particles are oriented by being subject to the first magnetic field of the spinning permanent magnet assembly, thereby aligning the magnetic or magnetizable pigment particles accordingly. Subsequently or partially simultaneously (as described in WO 20121038531 A1) with the orientation of the magnetic or magnetizable pigment particles by being subjected to the first magnetic field of the spinning permanent magnet assembly, the coating composition comprising said pigment particles is hardened to thereby fix or freeze the magnetic pigment particles in the oriented state. By "partially simultaneously", it is meant that both steps are partly performed simultaneously, i.e. the times of performing each of the steps partially overlap. In the context described herein, when hardening is performed partially simultaneously with the orientation step b), it must be understood that hardening must become effective after the orientation so that the pigment particles orient before the complete hardening of the OEL.

Therefore, the apparatus described herein may further include a hardening device so that the coating composition is hardened partially simultaneously or after the magnetic or magnetizable pigment particles have been oriented and the magnetic or magnetizable pigment particles can be fixed or frozen in the oriented state. The hardening device may be arranged along the path of the substrate above the cylinder described herein.

Hardening the coating composition is generally induced by applying an external stimulus to the coating composition (i) after its application on a substrate surface and (ii) subsequently or partially simultaneously with the orientation of the magnetic or magnetizable pigment particles. Advantageously the hardening of the coating composition is carried out partially simultaneously with the orientation of the magnetic or magnetizable pigment particles. Therefore, preferably the coating composition is an ink or coating composition selected from the group consisting of radiation curable compositions, thermally drying compositions, oxidatively drying compositions, and combinations thereof. Particularly preferably, the coating composition is an ink or coating composition selected from the group consisting of radiation curable compositions. Radiation curing, in particular UV-Vis curing, advantageously leads to a rapid increase in viscosity of the coating composition after exposure to the curing radiation, thus preventing any further movement of the pigment particles and in consequence any loss of orientation after the magnetic orientation step.

It was further found that a very compact system could be assembled if the motion of the permanent magnet assembly is not constrained with a rigid shaft or spindle to transfer the force of the motor, as taught by the prior art. A preferred set of embodiments are therefore those where the permanent magnet assembly is free to spin around its principal axis of inertia within the housing. In such a case, the permanent magnet assembly is provided as a rotatable journal of a journal bearing. The spinning of the permanent magnet assembly occurs by sliding against a radially arranged bearing surface as in a journal bearing. The use of sliding type bearing provides for a relatively simple construction.

When the permanent magnet assembly is provided as a rotatable journal of a journal bearing, the housing may define the bearing part of said journal bearing described hereabove. The housing may include upper and lower bearing surfaces through which a central rotational axis of the permanent magnet assembly passes. The housing may support the winding assembly comprising the one or more windings, in particular the one or more magnet-wire coils. In particular, one or more windings, in particular one or more magnet-wire coils, of the winding assembly may be supported by the housing by being wrapped around the housing, optionally an outside surface of the housing. The housing may be removably mountable to the rotating or rotatable cylinder described herein. The provision of such a modular housing including both the winding assembly comprising the one or more windings, in particular the one or more magnet-wire coils, and the permanent magnet assembly allows for ease of integration into machinery for making the optical effect layer on the substrate and servicing of such. The various features described in this paragraph relating to the housing may be individually applied to the housing, irrespective of the order given above, and any two or more of these features of the housing may be combined.

The housing comprising the pieces such as for example a and b must be made of a low or non-electrically conducting material since electrically conducting materials would noteworthy slow down the permanent magnet assembly movement and/or increase the power consumption of the magnet-wire coils, due to the generation of eddy-currents. Engineering polymers or plastics including without limitation polyamides, polyesters, copolyetheresters, high-density polyethylenes, polystyrenes, polycarbonates and liquid crystal polymers are thus the preferred materials for the construction of the housing of the device. More preferably, the housing described herein is made of a low friction material or a composition comprising one or more low friction materials. Typical example of low friction materials include without limitation polytetrafluoroethylene resins (PTFE) and polyacetal resins (also called polyoxymethylene, POM). However, low-conducting metals such as titanium and titanium alloys, or non-magnetic steels, can also be used as the housing material. Titanium-based materials have the advantage of excellent mechanical stability while being easily worked.

The two parts a and b described herein of the housing may be made of the same material, or of different materials.

The permanent magnet assembly may be coated with a low-friction material, such as for example parylene, polytetrafluoroethylene (PTFE), polyacetal resin or pyrolytic carbon (graphite).

The device described herein may comprise an optional shaft. On the contrary to the prior art where the shaft is aimed at transferring the force of the motor, the optional shaft described herein only serves to hold the permanent magnet assembly in its spinning position, and is constrained within the housing. In a preferred embodiment, the permanent magnet assembly is freely spinneable around the central shaft, without touching the housing otherwise. The shaft may be anchored in two bearings disposed above and below the permanent magnet assembly. Preferably, the shaft is anchored in a single bearing on the opposite side of the printed surface, such as to let free the side of the permanent magnet assembly closest to the printed surface. Such an arrangement has the advantage of not perturbing the magnetic orientation field. Preferably, the bearings are ball-bearings having non-magnetic, preferably low or non-electrically conducting balls. In a further embodiment, the permanent magnet assembly may be entirely comprised inside a single ball-bearing of corresponding diameter, having non-magnetic, preferably low or non-electrically conducting balls.

With the aim of reducing friction between the permanent magnet assembly and its housing, lubricating agents may be used. Such lubricating agents include without limitation mineral oils, vegetable oils, synthetic oils, greases, silicone greases, fluoropolymer greases, oil-based and water-based ferrofluids as well as solid lubricants such as for example graphite powder, tungsten disulfide, molybdenum disulfide and polytetrafluoroethylene.

As described hereabove, the apparatus described herein comprises a stator comprising the electromagnet assembly including a winding assembly comprising the one or more windings, in particular the one or more magnet-wire coils. The one or more magnet-wire coils are preferably simple air-wound magnet-wire coils without a magnetic core.

Alternatively, the one or more magnet-wire coils may comprise a magnetic core of soft magnetic material, such as for example annealed iron, nickel, cobalt, carbon steel, silicon steel, carbonyl iron, soft ferrite like manganese-zinc ferrite or nickel-zinc ferrite, nickel-iron alloys, cobalt-iron alloys, amorphous metal alloys like Metglas® (iron-boron alloy). The magnet wire is preferably a lacquer-insulated magnet wire and more preferably a lacquer-insulated copper wire, such as those used for winding electromagnet coils.

The one or more magnet-wire coils are preferably wound directly onto the housing described herein, comprising the permanent magnet assembly described hereabove and suitably configured such as to support the wire turns of the magnet-wire coils. In a preferred embodiment and as shown in FIG. 2*b*, the housing may comprise U-shaped indentations (also referred to as notches) (U) for receiving the magnet-wire coil windings.

As already mentioned, the apparatus is configured to spin the permanent magnet assembly by setting up a secondary magnetic field via the electromagnet assembly that oscillates or rotates to spin the permanent magnet assembly by interaction of the first magnetic field of the permanent magnet assembly and the oscillating or rotating second magnetic field produced by the electromagnet assembly. Where the electromagnet assembly comprises a winding assembly comprising the one or more windings, in particular the one or more magnet-wire coils, and drive, one or more permanent magnets of the permanent magnet assembly are spinned by driving a current through the electromagnet assembly, which produces a second magnetic field that oscillates (single winding drive) or rotates (2, 3 or more windings) to turn the permanent magnet assembly by an interaction of the magnetic field of the permanent magnet assembly and the oscillating or rotating second magnetic field produced by the driven electromagnet assembly. This apparatus can be thought of as an electric motor whereby a stator is provided by the winding assembly comprising the one or more windings, in particular the one or more magnet-wire coils, and drive and a rotor is provided by the permanent magnet assembly.

In an embodiment of the apparatus aspect, the winding assembly and drive is configured as a polyphase stator for producing the rotating magnetic field. The winding assembly and current drive is configured as two, three or more phase (although preferably three phase), to produce the rotating second magnetic field. A two, three or more phase current will be applied to respective windings of the winding assembly. The resulting magnetic field produced by the winding assembly will rotate in a known manner (per se), The rotating magnetic field interacts with the first magnetic field produced by the permanent magnet assembly to force the permanent magnet assembly to spin. A polyphase system can provide better control of spinning of the permanent magnet assembly than a single phase solution.

In an embodiment of the apparatus aspect, the winding assembly comprises a plurality of windings connected to the drive and the windings are driven in sequence to produce the rotating second magnetic field. The permanent magnet assembly spins as the permanent magnet assembly follows the rotation of the rotating second magnetic field. The drive may be configured to apply suitably phase shifted alternating current (e.g. sinusoidal) to the windings, respectively, or the drive may be configured to apply phase shifted current to the windings, respectively in a square wave form. That is, the drive may be configured to sequentially turn one of the windings on (or high) with the other windings off (or low) and repeat this in sequence to create the rotating second magnetic field.

In an embodiment of the method aspect, the electromagnet assembly comprises a plurality of windings and an electric supply is applied to the windings in such a way to create the rotating second magnetic field. There may be two, three or more windings respectively connected to a different phase of the electric supply. The electric supply is suitably phase shifted between the plural phases to provide a rotationally symmetric rotating second magnetic field. The rotating second magnetic field interacts with the first magnetic field of the permanent magnet assembly to force the permanent magnet assembly to spin.

FIG. 2*a* schematically illustrates a device comprising a magnet-wire coil (C1) made of a magnet wire surrounding the pieces a and b of the housing. FIG. 2*b* schematically illustrates an explosion view of the device represented in FIG. 2*a*.

Figure 2C:
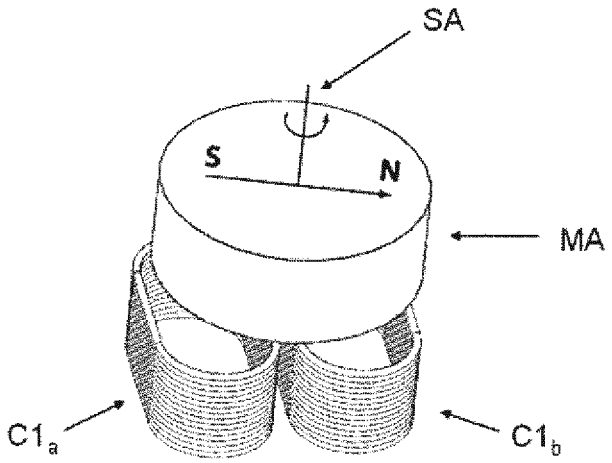
FIG. 2*c* schematically illustrates a device described herein comprising a two-element magnet-wire coil ($C1_a$ and $C1_b$) disposed below a permanent magnet assembly (MA) with a spinning axis (SA).

Alternatively, the one or more magnet-wire coils consist of two-element magnet-wire coils ($C1_a$ and $C1_b$), as shown in FIG. 2*c*. Said two elements are disposed side by side below the permanent magnet assembly (MA), on the side of (MA) facing away from the surface of the rotating cylinder. They are wound such that their magnetic axis is substantially parallel to the spinning axis of the permanent magnet assembly (MA). The advantage of this disposition of the magnet-wire coil is that it is possible to bring the permanent magnet assembly very close to a substrate carrying a wet and not yet hardened coating composition comprising magnetic or magnetizable pigment particles.

Figure 2D:
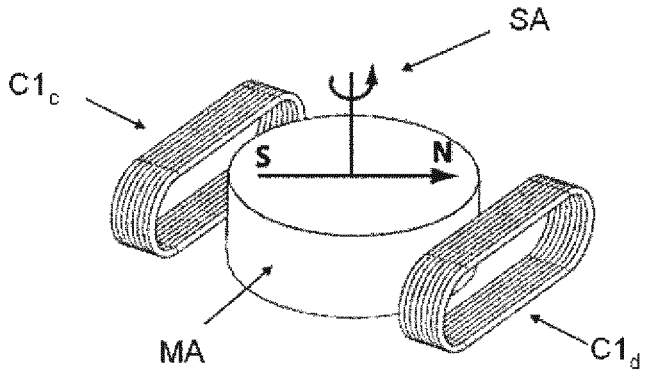
FIG. 2*d* schematically illustrates a device described herein comprising a two-element magnet-wire coil ($C1_c$ and $C1_d$) disposed on each side of a permanent magnet assembly (MA) with a spinning axis (SA).

In yet another variant, and as shown in FIG. 2*d*, a two-element magnet-wire coil ($C1_c$ and $C1_d$) may be disposed on each side of the permanent magnet assembly (MA) thereby forming a linear arrangement perpendicular to the spinning axis (SA), and wound such that the magnetic axis of the coil is perpendicular to the spinning axis of the permanent magnet assembly. The advantage of this disposition is that the thickness of the whole device is reduced to the minimum possible and that it is possible to bring the permanent magnet assembly very close to a substrate carrying a wet and not yet hardened coating composition comprising magnetic or magnetizable pigment particles.

Figure 2E:
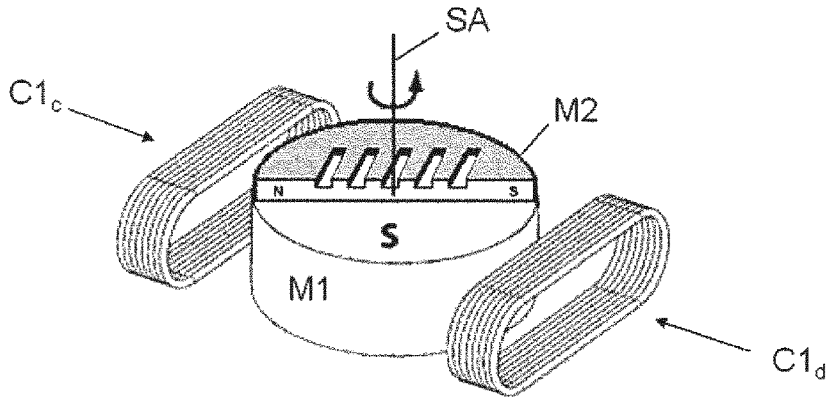
FIG. 2*e* schematically illustrates a device described herein comprising a two-element magnet-wire coil ($C1_c$ and $C1_d$) disposed on each side of a permanent magnet assembly (MA) having a spinning axis (SA) and comprising (i) a disk-shaped permanent magnet (M1) and (ii) a secondary magnet (M2) in the form of an engraved magnetic plate and having its magnetic axis perpendicular to the magnetic axis of the permanent magnet (M1) and perpendicular to the spinning axis (SA).

In yet another variant, and as shown in FIG. 2*e*, the magnet assembly (MA) may comprise a permanent magnet (M1) and a permanent magnet (M2) being an engraved magnetic plate.

According to one embodiment, the method described herein comprises sensing one or more attributes of the first magnetic field, e.g. intensity or other indicator of rotational position, and controlling timing of driving of the winding assembly based on the sensed attribute. According to one embodiment, the apparatus described herein comprises a sensor assembly, said sensor assembly being provided to sense an attribute of the first magnetic field, e.g. intensity or other indicator of rotational positional, generated by the permanent magnet assembly, and the apparatus comprises a controller (e.g. a processor or control circuitry) configured to use the sensed attribute to time driving of the electromagnet assembly, i.e. configured to control timing of driving the winding assembly based on the sensed attribute, e.g. intensity or other indicator of rotational position. In an embodiment, the controller implements a control loop based on the sensed attribute to control the speed of spinning of the permanent magnet assembly. In an embodiment of the method aspect, the method comprises sensing the attribute of the first magnetic field generated by the permanent magnet assembly, using the sensed attribute, e.g. intensity, to time driving of the electromagnet assembly. The method may comprise implementing a control loop based on the sensed attribute to control the speed of spinning of the permanent magnet assembly. The sensor assembly may comprise one or more sensors. The number of sensors may match the number of windings in the winding assembly. The sensor may be Hall effect sensors.

Figure 4:
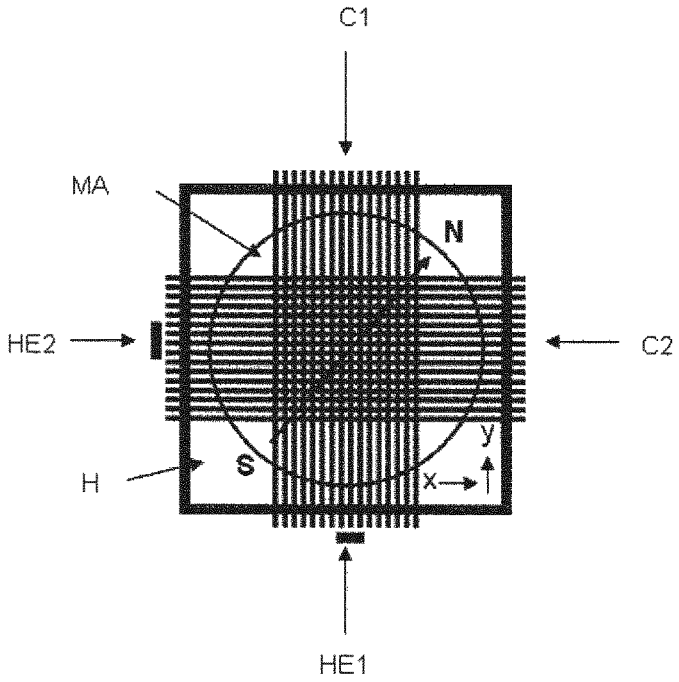
FIG. 4 schematically illustrates a second exemplary embodiment of the device described herein having a permanent magnet assembly (MA) in a housing (H), a pair of crossed magnet-wire coils (C1, C2) and a pair of optional Hall-elements (HE1, HE2).

In a preferred embodiment and as shown in FIG. 4, the permanent magnet assembly (MA) is contained within a pair of crossed magnet-wire coils (C1 and C2), preferably arranged perpendicularly to each other; such a crossed configuration of the magnet-wire coils has the advantage that it is possible, through the use of a two-phase current controller, to orient the permanent magnet assembly in any desired direction, or to make it spin in any sense at a desired frequency. Contrary to the single magnet-wire coil arrangement, the crossed-coil arrangement has no dead centre.

Figure 5:
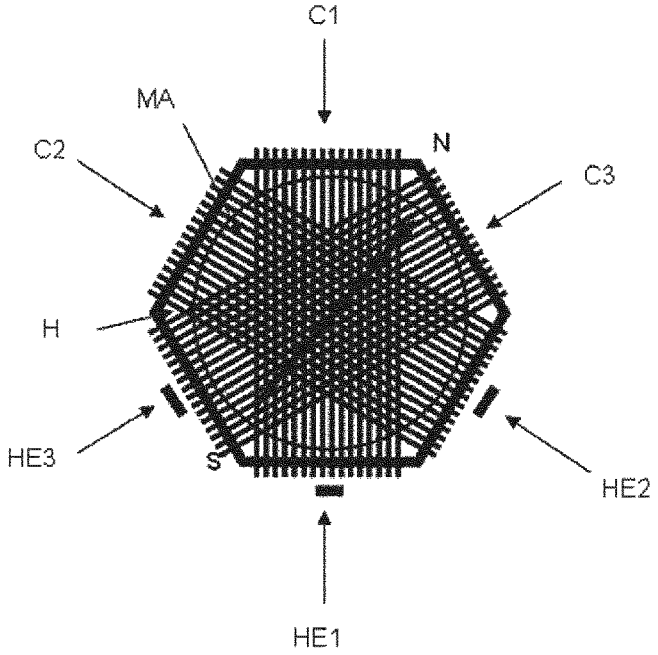
FIG. 5 schematically illustrates a third exemplary embodiment of the device described herein having a permanent magnet assembly (MA) in a housing (H), three magnet-wire coils (C1, C2, C3) disposed at mutual angles and optional Hall-elements (HE1, HE2, HE3).

In another preferred embodiment and as shown in FIG. 5, the permanent magnet assembly (MA) is contained within three magnet-wire coils (C1, C2 and C3), arranged at mutual angles of 120 degrees; such a configuration of the magnet-wire coils advantageously allows the permanent magnet assembly to spin forward or backward at a desired frequency through driving the magnet-wire coils with a three-phase-current controller.

The controllers needed for appropriately addressing the electromagnet assembly including a winding assembly comprising the one or more windings, in particular the one or more magnet-wire coils with electric currents are known in the art, and include for example computer fan motor controllers comprising a Hall-effect sensor, logics, and current switches or a H-bridge. The fan motor controllers are arranged with respect to the permanent magnet assembly (MA), such that the currents in the magnet-wire coils are appropriately switched on and off for inducing spinning of the permanent magnet assembly as desired.

Figure 6A:
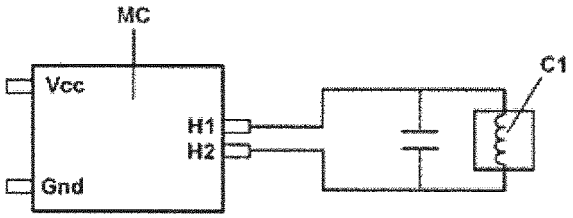
FIGS. 6*a*-6*c* schematically illustrate three embodiments of electric motors driving circuits for driving the magnet-wire coils of embodiments of FIG. 3-FIG. 4 and FIG. 5, and therefore spinning a permanent magnet assembly (MA) described herein.

In case of a single magnet-wire coil and as shown in FIG. 6*a*, a single-phase Hall-effect fan motor controller (MC) such as for example a AH5771 integrated circuit, having a H-bridge switch (H1, H2), is required, for inverting the sense of the current flowing through the magnet-wire coil (C1) in response to the position of the permanent magnet assembly (MA).

In case of a pair of crossed magnet-wire coils, a two-phase Hall-effect fan motor controller having two on/off switches, one for each magnet-wire coil, can be used. However and preferably, two suitably disposed single-phase Hall-effect fan motor controllers, such as for example a AH5771 integrated circuit, having a H-bridge switch for inverting the sense of the current flowing through their respective magnet-wire coils in response to the position of the permanent magnet assembly (MA), are used. Similarly, in case of three magnet-wire coils, the magnet-wire coils can be driven by three suitably disposed single-phase Hall-effect fan motor controllers, such as for example a AH5771 integrated circuit, having a H-bridge switch for inverting the sense of the current flowing through their respective magnet-wire coils in response to the position of the permanent magnet assembly.

In a preferred embodiment, the one or more magnet-wire coils are driven with the help of an externally generated alternating current of known frequency. Such external driving has the advantage that the frequency of the driving current, and thus the spinning frequency, can be precisely set, and may for example follow an acceleration ramp after switching the current on, in order to overcome the rotational inertia of the permanent magnet assembly (MA). Similarly, a deceleration ramp can be followed before switching the current off, in order to bring the permanent magnet assembly (MA) rapidly to rest.

In a preferred embodiment, two crossed magnet-wire coils are used, and the magnet-wire coils are driven by a stepper motor controller. In a more preferred embodiment (FIG. 6*c*), a stepper motor controller (MC) controlled by a microprocessor (P) is used; this has the advantage of a high flexibility and of a perfect control of the position and rotation of the permanent magnet assembly (MA) within the magnet-wire coils. A stepper motor can noteworthy be advanced in either direction in single steps, half steps or in any desired fractional steps, by addressing its magnet-wire coils with appropriate currents. Two crossed magnet-wire coils represent a simple stepper motor configuration. Through an appropriate combination of currents in the two crossed magnet-wire coils, the permanent magnet assembly can be oriented in any desired direction within the magnet-wire coils, and through appropriate changes of the magnet-wire coil currents, the permanent magnet assembly can be put in any desired spinning state (spinning frequency) in forward or backward direction.

Other magnet-wire coils arrangements may be used as known by the person skilled in the art.

The device described herein may advantageously comprise in addition one or more static magnets, in particular engraved magnetic plates such as those disclosed for example in WO 2005/002866 A1 and WO 2008/046702 A1. Such an engraved plate may be made from iron (iron yokes). Alternatively, such an engraved plate may be made from a plastic material in which magnetic particles are dispersed (such as for example Plastoferrite). In this way, the optical effect produced by the rotating permanent magnet assembly can be overlaid with a magnetically induced fine-line pattern, such as a text, an image or a logo.

In an embodiment of the method and apparatus aspects, a plurality of the permanent magnet assemblies and associated electromagnet assemblies are arranged adjacent to one another longitudinally and/or laterally with respect to the substrate in order to create a plurality of individual optical effect layers. The adjacent permanent magnet assemblies are each able to produce the first magnetic field and are each spinneable by interaction of the first magnetic field with the oscillating or rotating second magnetic field of the individual electromagnet assemblies. Each permanent magnet assembly will thus aggregately orient the magnetic or magnetizable pigment particles according to the pattern defined by the first magnetic field to create an individual optical effect layer. The individual optical effect layers will be spaced, but adjacent to one another, along the substrate according to the spacing and arrangement of the permanent magnet assemblies.

According to one embodiment, the apparatus described herein comprises a rotatable cylinder having the permanent magnet assembly spinneably installed in the cylinder for applying the first magnetic field produced by the permanent magnet assembly as the cylinder rotates to the magnetic or magnetizable pigment particles whilst the permanent magnet assembly spins under interaction with the oscillating or rotating second magnetic field produced by the electromagnet assembly. In an embodiment, the feeding mechanism is configured to feed the substrate and the cylinder is configured to rotate so that the portion of the substrate carrying the coating composition comprising the magnetic or magnetizable pigment particles exposed to the first magnetic field is stationary relative to the permanent magnet assembly. In the case when the apparatus described herein comprises a rotatable cylinder having a plurality of individual permanent magnet assemblies spinneably installed in the cylinder and associated electromagnet assemblies, the portions of the substrate carrying the coating composition comprising the magnetic or magnetizable pigment particles exposed to the first magnetic field of each individual permanent magnet assembly is stationary relative to the individual permanent magnet assemblies.

The substrate is able to be fed continuously by the feeding mechanism and wrapped around the outer surface of the cylinder. The peripheral speed of the rotating cylinder and the feeding speed of the substrate are synchronized so that the portion of the substrate associated with the exposed magnetic or magnetizable pigment particles in a wet and not yet hardened coating composition remains stationary relative to the permanent magnet assembly. The substrate and the rotating cylinder move together as the rotating first magnetic field of the permanent magnet assembly is applied to the magnetic or magnetizable pigment particles to aggregately orient the magnetic or magnetizable pigment particles to create the desired optical effect layer.

Thinking in terms of the motion of the portion of the substrate carrying the coating composition comprising the magnetic or magnetizable pigment particles, this is initially upstream of the rotating cylinder, but is fed by the feeding mechanism in a downstream direction to wrap around the cylinder, thereby to bring the portion of the substrate carrying the coating composition comprising the magnetic or magnetizable pigment particles into exposure to the first magnetic field during wrapping around of the rotating cylinder, eventually to be brought downstream of the rotating cylinder. In this way, the portion of the cylinder over which the substrate is wrapped defines the exposure time of the magnetic or magnetizable pigment particles to the rotating first magnetic field of the permanent magnet assembly. In an embodiment, the drive is configured to generate an oscillating or rotating second magnetic field so that the permanent magnet assembly revolves fully at least once during the exposure time.

In an embodiment of the method aspect, the substrate is fed in a machine direction and the permanent magnet assembly moves at the same speed in the machine direction during application of the first rotating magnetic field to the magnetic or magnetizable pigment particles in a wet and not yet hardened coating composition to aggregately orient the magnetic or magnetizable pigment particles for creating the optical effect layer. In an embodiment, the permanent magnet assembly is incorporated in an outer peripheral margin of a rotating cylinder. In an embodiment, the plurality of permanent magnet assemblies and associated electromagnet assemblies are incorporated in an outer peripheral margin of a rotating cylinder.

In an embodiment of the method aspect, the substrate is fed by being supported on a rotating cylinder and the exposed portion of the substrate is held stationary relative to the rotating cylinder. The permanent magnet assembly is caused to spin relative to the substrate and an outer peripheral surface of the rotating cylinder by interaction of the oscillating or rotating second magnetic field and the first magnetic field of the permanent magnet assembly.

In an embodiment, a plurality of permanent magnet assemblies and associated electromagnet assemblies is distributed circumferentially about an outer periphery of the cylinder to simultaneously create numerous individual and spaced optical effect layers on the substrates by orienting the magnetic or magnetizable pigment particles.

The methods and apparatuses described herein are particularly suitable for making optical effect layers in the field of security, cosmetic and/or decorative applications. According to one embodiment, the substrate described herein is a security document such as those described hereabove.

Also described herein are uses of the apparatus described herein for making an optical effect layer on the substrate, said substrate being preferably a security document.

Also described herein are methods for protecting a security document, said method comprising the steps of i) applying, preferably by a printing process described herein, the coating composition comprising magnetic or magnetizable pigment particles described herein on the substrate described herein, ii) exposing the coating composition to the magnetic field of apparatus described herein so as to aggregately orient at least a part of magnetic or magnetizable pigment particles, and iii) hardening the coating composition so as to fix the magnetic or magnetizable pigment particles in their adopted orientations.

Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transaction cards, access documents or cards, entrance tickets, public transportation tickets or titles and the like, preferably banknotes, identity documents, right-conferring documents, driving licenses and credit cards. The term "value commercial good" refers to packaging materials, in particular for cosmetic articles, nutraceutical articles, pharmaceutical articles, alcohols, tobacco articles, beverages or foodstuffs, electrical/electronics articles, fabrics or jewelry, i.e. articles that shall be protected against counterfeiting and/or illegal reproduction in order to warrant the content of the packaging like for instance genuine drugs. Examples of these packaging materials include without limitation labels, such as authentication brand labels, tamper evidence labels and seals.

SPECIFIC EMBODIMENTS

FIG. 2*a* schematically illustrates a first embodiment (embodiment 1) of the device described herein, said device comprising a housing composed of two pieces a and b, a single magnet-wire coil (C1) and a Hall-element (HE1) as described hereabove. FIG. 2*b* is an explosion view of the housing comprising pieces a and b, wherein piece b has a central cylindrical cavity for receiving the permanent magnet assembly (MA), and U-shaped indentations (notches) (U) to accommodate for the windings of the magnet-wire coil (C1) described hereabove.

FIG. 2*c* schematically illustrates a variant of the first embodiment described hereabove, where the single magnet-wire coil (C1) is a two-element magnet-wire coil, i.e. is made of two parts $C1_a$ and $C1_b$, disposed side-by-side below the permanent magnet assembly (MA), such that their magnetic axis is substantially parallel to the spinning axis of the permanent magnet assembly. FIG. 2*d* schematically illustrates another particular embodiment, where the single magnet-wire coil (C1) is made of two parts $C1_c$ and $C1_d$ disposed in-line, such that their magnetic axis is substantially perpendicular to the spinning axis of the permanent magnet assembly. FIG. 2*e* schematically illustrates another particular embodiment, where the permanent magnet assembly (MA) comprises more than one permanent magnets, (M1) and (M2), (M2) being an engraved magnetic plate.

Figure 3:
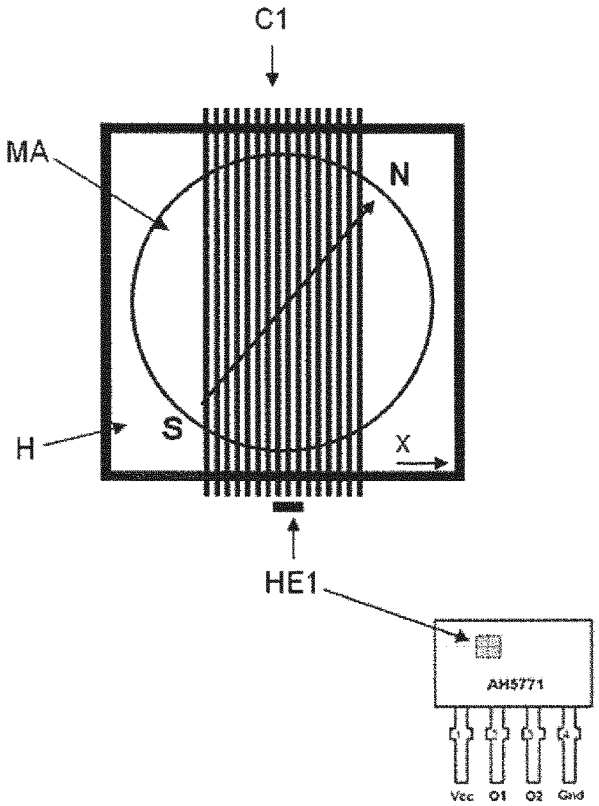
FIG. 3 schematically illustrates a first exemplary embodiment of the device described herein having a permanent magnet assembly (MA) in a housing (H) and a single magnet-wire coil (C1) and an optional Hall-element (HE1) comprised in an integrated circuit, the optional Hall-element (HE1) being placed at the middle of the outer side of the magnet-wire coil (C1).

FIG. 3 schematically illustrates the first embodiment described hereabove, said device comprising i) a disk-shaped permanent magnet (M1) magnetized along its diameter and being rotatably contained in a housing (H), and ii) a single magnet-wire coil (C1) disposed around the magnet (M1) and its housing (H). The device described herein further comprises a Hall-element (HE1) for driving the magnet-wire coil (C1). The integrated circuit AH5771 is disposed at the middle of the outer side of the magnet-wire coil, in the plane of the spinning magnet disk, such that the Hall-element reverses polarity each time the magnetic axes of the magnet-wire coil and the magnet disk are aligned, thus driving the magnet disk forth a further half revolution. The FIG. 3 shows also the location of the Hall-element (HE1) within the AH5771 integrated circuit.

FIG. 4 schematically illustrates a second embodiment (embodiment 2) of the device described herein, said device comprising i) a permanent magnet assembly (MA) comprising a disk-shaped permanent magnet (M1) magnetized along its diameter and being spinneably contained in housing (H), and ii) two magnet-wire coils in perpendicular arrangement to each other (C1, C2) and being disposed around the permanent magnet assembly (MA) and its housing (H). The device described herein further comprises two Hall-elements (HE1 and HE2) for driving the magnet-wire coils. The same circuit scheme as in the first embodiment is used, with two AH5771 integrated circuits, each one being placed at the middle of the outer side of each magnet-wire coil, in the plane of the spinning magnet disk.

FIG. 5 schematically illustrates a third embodiment (embodiment 3) of the device described herein, said device comprising i) a disk-shaped permanent magnet (M1) magnetized along its diameter and being spinneably contained in housing (H) and ii) three magnet-wire coils (C1, C2, C3) at mutual angles of 120° disposed around the magnet (M1) and its housing (H), as seen from the top. The device further comprises three Hall-elements (HE1, HE2 and HE3) for driving the magnet-wire coils.

In a variant of the embodiments 1-3, the permanent magnet assembly (MA) is parylene-coated to reduce rotational friction. In another variant, a ferrofluid is added between the housing (H) and the permanent magnet assembly (MA) to reduce rotational friction.

In principle, the spinning axis of the permanent magnet assembly (MA) may have any arbitrary orientation with respect to the surface of the rotating cylinder.

In a set of preferred embodiments, the device according to the embodiments 1-3 may be placed in such a way that the spinning axis of the permanent magnet assembly (MA) is

Figure 1B:
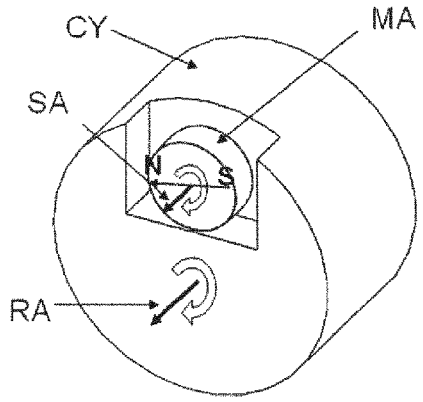
FIG. 1*b* schematically illustrates a rotating cylinder (CY) carrying a spinning permanent magnet assembly (MA) having its spinning axis (SA) parallel to the rotation axis (RA) of the rotating cylinder (CY). The spinning axis (SA) extends parallel to the substrate carried on the cylinder (CY).
Figure 1C:
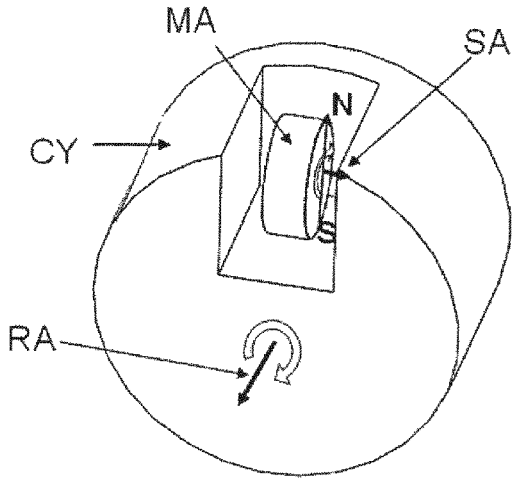
FIG. 1*c* schematically illustrates a rotating cylinder (CY) carrying a spinning permanent magnet assembly (MA) having its spinning axis (SA) perpendicular to the rotation axis (RA) of the rotating cylinder (CY) and parallel to the tangent of the rotating cylinder (CY). The spinning axis (SA) extends parallel to the substrate carried on the cylinder (CY).

- either perpendicular both to the rotation axis of the rotating cylinder and to the tangent of the cylinder surface as depicted in FIG. 1*a*
- parallel to the rotation axis of the cylinder as depicted in FIG. 1*b*, or
- perpendicular to the rotation axis of the rotating cylinder and parallel to the tangent of the cylinder surface as depicted in FIG. 1*c*.

Figure 6B:
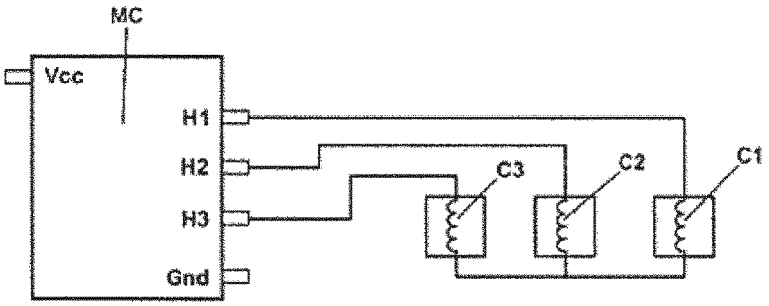
Figure 6C:
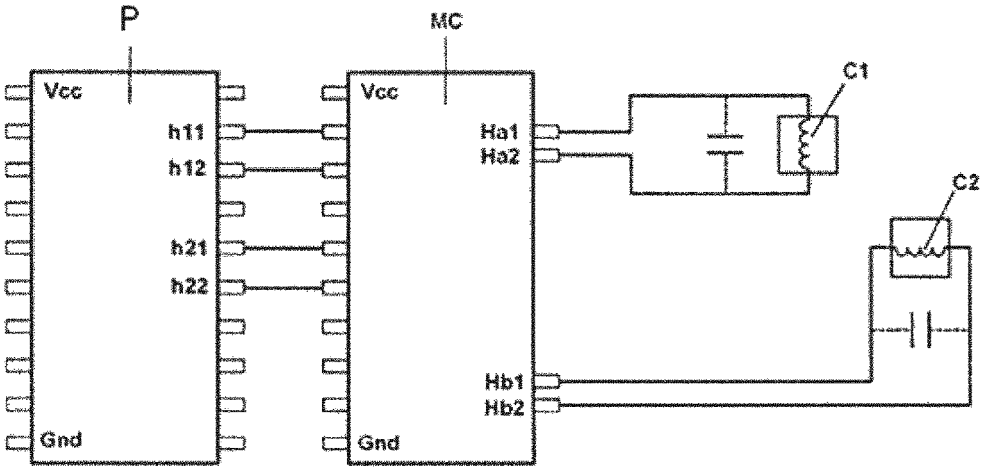

FIGS. 6*a*-6*c* show three electric motor driving circuits suitable for spinning the permanent magnet assembly (MA):

6*a*) driving with a single magnet-wire coil (C1) and a Hall-effect driven motor controller (MC) having a H-bridge output (H1, H2);

6*b*) driving with three magnet-wire coils (C1, C2, C3) arranged at mutual angles of 120° and a tri-phase motor controller (MC) having half-H-bridge outputs (H1, H2, H3);

6*c*) driving with two crossed magnet-wire coils (C1, C2), a double-H-bridge motor controller (MC), and a programmable microprocessor (P) driving the motor controller's H-bridges. Vcc and Gnd stand for voltage at the common collector and ground, respectively.

Figure 7:
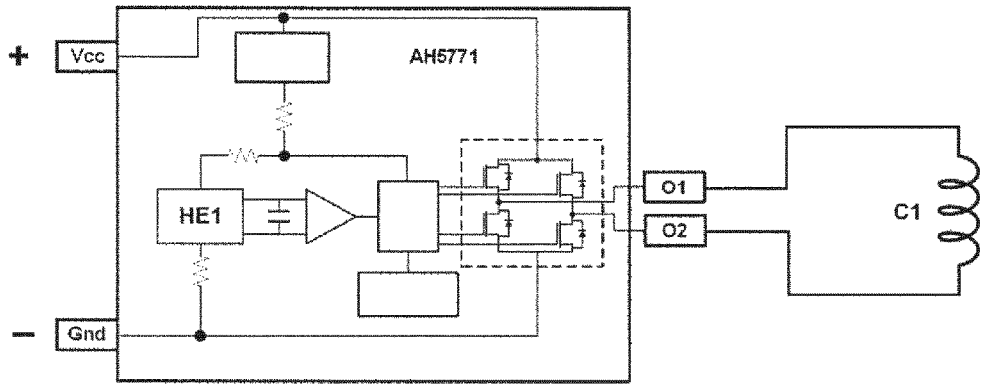
FIG. 7 schematically illustrates an integrated circuit scheme for driving a single magnet-wire coil (C1) for spinning a permanent magnet assembly (MA) described herein.

FIG. 7 shows a circuit scheme embodiment for a single magnet-wire coil (C1) spinning permanent magnet assembly (MA) described herein. A Hall-element based integrated circuit AH5771, manufactured by Diodes Inc., was used for commuting the current inside the magnet-wire coil. The Hall-Sensor is integrated in the circuit, together with the required amplifier, controller logic and the coil-current carrying H-bridge.

The skilled person can envisage further modifications to the specific embodiments described above without departing from the spirit described herein. Such modifications are encompassed by the present invention.

The present invention will now be further described by way of Examples, which are not intended to limit its scope in any way.

EXAMPLES

All examples have been carried out by using the UV-curable screen printing ink of the formula given in Table 1 below.

TABLE 1

| | |
|---|---|
| Epoxyacrylate oligomer | 36% |
| Trimethylolpropane triacrylate monomer | 13% |
| Tripropyleneglycol diacrylate monomer | 20% |
| Genorad 16 (Rahn) | 1% |
| Aerosil 200 ® (Evonik) | 1% |
| Speedcure TPO-L (Lambson) | 2% |
| Irgacure ® 500 (BASF) | 6% |
| Genocure EPD (Rahn) | 2% |
| BYK ®-053 (BYK) | 2% |
| platelet-shaped 7-layer optically variable magnetic pigment particles (*) | 17% |

(*) green-to-blue optically variable magnetic pigment particles of diameter d50 about 15 μm and thickness about 1 μm, obtained from JDS-Uniphase, Santa Rosa, CA.

Example 1

A device according to the first specific embodiment described hereabove and illustrated in FIGS. 2*a*, 2*b* and 3 was used to orient the non-spherical optically variable magnetic pigments of the ink detailed in Table 1. Said device comprised:

i) a 30 mm×30 mm housing (H), consisting of two pieces cut out of plates made of polyoxymethylene (Maagtechnic Daetwyler) according to FIG. 2*b* and having the following characteristics: pieces a: 30 mm×30 mm×1 mm, piece b: 30 mm×30 mm×4.3 mm, with a central cylindrical cavity having a diameter of 25.3 mm and a depth of 3.3 mm.

ii) a nickel-coated NdFeB disk-shaped permanent magnet (M1) (Webcraft GmbH) of diameter 25 mm and thickness 3 mm, magnetized along its diameter. The permanent magnet was placed inside the cavity of piece b.

iii) a magnet-wire coil (C1) (POLYSOL 155 1X0, 15 mm HG Distrelec AG) wound around the assembly in x-direction, over a length of 25 mm, in two tight layers. The magnet-wire coil comprised a total of 240 turns.

iv) a single phase motion controller (MC) (DIODES AH5771) to drive the magnet-wire coil (C1) according to FIGS. 6*a* and 7. The Hall element (HE1) of the motion controller was placed in the middle of the outer side of the magnet-wire coil, as shown in FIG. 3.

This device was powered by a Li-ion rechargeable battery (3.7V, 430 mAh, Nikon EN-EL11). The device and the battery were inserted in a 40×40 mm polymeric holder having a convex upper surface of curvature of 275 mm diameter, the lower surface of the holder being flat and the maximum thickness of the holder in its centre measuring 15.2 mm. The device was placed into the polymeric holder in such a way that the spinning axis of the permanent magnet was perpendicular to the printing direction, as depicted in FIG. 1*a*. The device comprising the single magnet-wire coil assembly, the battery and the polymeric holder was placed into a PEEK (poly(ether ether ketone)) adapter inserted into a recess of the rotating cylinder (diameter: 275 mm) of a sheet-fed KBA NotaSys Notascreen II screen printing unit. The geometry of the PEEK holder is described in FIG. 10 of EP2114678 B1.

A 25 mm×25 mm square sample was printed onto a BOPP (bi-axially oriented polypropylene) substrate (Guardian, Innovia Security) with the UV-curable screen printing ink of Table 1 at a speed of 8000 sheets per hour. The thickness of the printed layer was about 20 μm. The rotating cylinder was rotating at a speed of 133 rpm. The permanent magnet was spinning at an estimated spinning frequency of 15-20 Hz.

Subsequently to the orientation of the non-spherical optically variable magnetic pigments, the ink was hardened directly on the rotating cylinder, as described in WO2012/038531 A1 and EP2433798 A1. The hardening device, consisting of UV-LED elements, had an output power of 8 W/cm$^2$ and was placed vertically above the rotating cylinder, at a distance of 1 cm of the printed substrate.

Figure 8A:
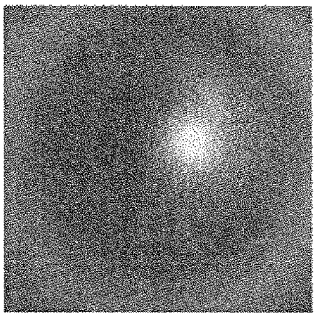

The resulting magnetic orientation image is given in FIG. 8*a*.

Example 2

A device according to the third specific embodiment described hereabove and illustrated in FIG. 5 was used. Said device comprised:

i) a regular hexagonal housing (H) consisting of polyoxymethylene (Maagtechnic Daetwyler) pieces a and b having the following characteristics: piece a: edge 24 mm, thickness 1 mm, piece b: edge 24 mm, thickness 4.3 mm, with a central cylindrical cavity having a diameter of 30.3 mm and a depth of 3.3 mm.

ii) a nickel-coated NdFeB disk-shaped permanent magnet (M1) (Webcraft GmbH, diameter: 30 mm diameter, thickness: 3 mm) magnetized along its diameter. The permanent magnet was placed inside the cavity of piece b.

iii) three magnet-wire coils C1, C2 and C3 (POLYSOL 155 1X0, 15 mm HG Distrelec AG) which were wound at a 120° angle to each other over the housing H, on a length of 12.5 mm, in three superimposed tight layers, as shown in FIG. 5. Each of the magnet-wire coils C1, C2 and C3 comprised a total of 120 turns.

iv) a Faulhaber MCBL 3002 Motion Controller (MC) to drive the magnet-wire coils C1, C2 and C3, according to FIG. 6*b*.

The device was powered by one 3LR12 alkaline manganese oxide battery (4.5V, 5400 mAh, Duracell MN1203).

A 25 mm×25 mm square sample was printed onto a cotton security paper (Landqart) with the UV-curable screen printing ink of Table 1 with a laboratory screen printing device. The thickness of the printed layer was about 20 μm. While the ink was in a not yet hardened state, the device described hereabove was placed on the rear face of the substrate, 3 mm below the printed area, and allowed to spin for a few seconds at an estimated spinning frequency of about 15 Hz. The spinning axis of the permanent magnet was perpendicular to the printing direction. The device was removed downwards while the magnet rotor was spinning, and the printed area was hardened under UV illumination, permanently fixing the orientation of the optically variable magnetic pigment particles.

Figure 8B:
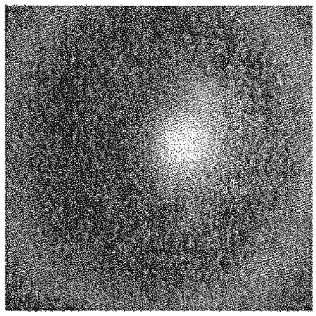

The resulting magnetic orientation image is given in FIG. 8*b*.

Example 3

A device according to the second specific embodiment described hereabove and illustrated in FIG. 4 was used. Said device comprised:

i) a 30 mm×30 mm housing (H), consisting of two pieces a and b made of polyoxymethylene (Maagtechnic Daetwyler) according to FIG. 2*b* and having the following characteristics: pieces a and b: piece a 30 mm×30 mm×1 mm, piece b: 30 mm×30 mm×4.3 mm with a central cylindrical cavity having a diameter of 25.3 mm and a depth of 3.3 mm.

ii) a nickel-coated NdFeB disk-shaped permanent magnet (M1) (Webcraft GmbH) of diameter 25 mm and thickness 3 mm, magnetized along its diameter. The permanent magnet was placed inside the cavity of piece b.

iii) two magnet-wire coils (C1 and C2) (POLYSOL 155 1X0, 15 mm HG Distrelec AG) wound over the assembly in x and y-direction, over a length of 25 mm, in one tight layer each. Each of the magnet-wire coils (C1 and C2) comprised a total of 120 turns.

iv) a Pololu Baby Orangutan robot controller comprising an ATmega 328P processor (P) and a Toshiba TB6612FNG motion controller (MC) according to FIG. 6*c*, having two driving H-bridges controlled by each a two-lines interface, all contained on a 30 mm×18 mm footprint printed circuit board and within 2.5 mm thickness, and operated at 5V voltage.

The ATmega 238P processor (P) was loaded with a stepper-motor program, so as to drive the permanent magnet (M1) around at choice in full-step, half-step or quarter-step mode at a desired speed in a desired direction. Alternatively, the ATmega 328P processor (P) was loaded with instructions to orient the magnet into a desired direction, or to make it perform other movements than a simple spinning around, like back and forth movements at a given position and within a desired angle.

Example 4

A variant of the device described in embodiment 1 was used to orient the non-spherical optically variable magnetic pigments of the ink detailed in Table 1. This device comprised:

i) a square housing (H) consisting of polyoxymethylene (Maagtechnic Daetwyler) pieces a and b, having the following characteristics: piece a: 15 mm×15 mm×1 mm, piece b: 15 mm×15 mm×7.3 mm, with a central cylindrical cavity having a diameter of 12.3 mm and a depth of 6.3 mm.

ii) a nickel-coated NdFeB disk-shaped permanent magnet (M1) (Webcraft GmbH) of diameter 12 mm and thickness 6 mm, magnetized along its diameter. The permanent magnet was placed inside the cavity of piece b.

iii) a single magnet-wire coil (C1) (POLYSOL 155 1X0, 15 mm HG Distrelec AG) wound around the assembly in x-direction, over a length of 12.5 mm, in two superimposed tight layers. The magnet-wire coil (C1) comprised a total of 120 turns.

iv) a single phase Hall-effect controller (HE1) (AH5771, DIODES Incorporated) to drive the magnet-wire coil as in the Example 1.

The permanent magnet assembly was powered by a CR2/3AA lithium battery (3V, 1350 mAh, Varta Electronics).

A 25 mm×25 mm square sample was printed onto a Landqart cotton security paper with the UV-curable screen printing ink of Table 1 with a laboratory screen printing device. The thickness of the printed layer was about 20 μm. While the ink was in a not yet hardened state, the device described hereabove was placed on the rear face of the substrate, 3 mm below the printed area, and allowed to spin for a few seconds at an estimated spinning frequency of about 15 Hz. The spinning axis of the permanent magnet was parallel to the printing direction. The device was removed downwards while the magnet rotor was spinning, and the printed area was hardened under UV illumination, permanently fixing the orientation of the optically variable magnetic pigment particles.

Figure 8C:
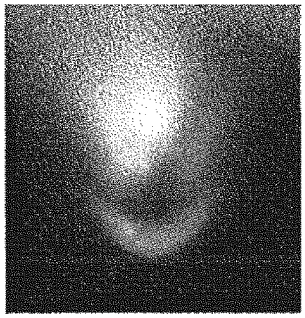

The resulting magnetic orientation image is given in FIG. 8*c*.

The invention claimed is:

1. A method of making an optical effect layer in a coating composition comprising magnetic or magnetizable pigment particles associated with a substrate using a permanent magnet assembly producing a first magnetic field and an electromagnet assembly producing an oscillating or rotating second magnetic field, the method comprising:

spinning the permanent magnet assembly to rotate the first magnetic field through interaction between the oscillating or rotating second magnetic field and the first magnetic field;

aggregately orienting the magnetic or magnetizable pigment particles upon exposure of the substrate to the rotating first magnetic field of the spinning permanent magnet assembly to create the optical effect layer, wherein the electromagnet assembly includes a winding assembly and a drive; and sensing an attribute of the first magnetic field and controlling timing of driving of the winding assembly based on the sensed attribute.

2. The method of claim 1, wherein the electromagnet assembly comprises polyphase windings and wherein a corresponding polyphase electric supply is applied to the windings to create the rotating second magnetic field.

3. The method of claim 1, wherein the permanent magnet assembly spins synchronously with the oscillating or rotating second magnetic field.

4. The method of claim 1, wherein the substrate is fed in a machine direction and the spinning permanent magnet assembly is moved at a same speed as the substrate in the machine direction as the first magnetic field aggregately orients the magnetic or magnetizable pigment particles in creating the optical effect layer.

5. The method of claim 4, wherein, as the permanent magnet assembly and the substrate move in the machine direction at the same speed, the permanent magnet assembly spins through at least one complete revolution as the first magnetic field is applied to the magnetic or magnetizable pigment particles.

6. The method of claim 1, wherein the coating composition is hardened one of partially simultaneously with or after the orienting of the magnetic or magnetizable pigment particles via the rotating first magnetic field of the spinning permanent magnet assembly, to thereby fix or freeze the magnetic or magnetizable pigment particles in an oriented state.

7. The method of claim 1, wherein the substrate is a security document preferably selected from the group consisting of banknotes, identity documents, right-conferring documents, driving licenses, credit cards, access cards, transportation titles, bank checks and secured product labels.

8. The method of claim 1, wherein the sensed attribute of the first magnetic field is indicative of at least one of intensity and rotational position of the first magnetic field.

* * * * *